US010118435B2

(12) United States Patent
Csokmay

(10) Patent No.: US 10,118,435 B2
(45) Date of Patent: Nov. 6, 2018

(54) LEVER-ACTUATED PEN

(71) Applicant: The Berea Hardwoods Co., Inc., Middleburg Heights, OH (US)

(72) Inventor: Joseph M. Csokmay, Parma, OH (US)

(73) Assignee: The Berea Hardwoods Co., Inc., Middleburg Heights, OH (US)

( * ) Notice: Subject to any disclaimer, the term of this patent is extended or adjusted under 35 U.S.C. 154(b) by 70 days.

(21) Appl. No.: 15/166,574

(22) Filed: May 27, 2016

(65) Prior Publication Data

US 2016/0375716 A1 Dec. 29, 2016

Related U.S. Application Data

(60) Provisional application No. 62/183,224, filed on Jun. 23, 2015.

(51) Int. Cl.

| | |
|---|---|
| ***B43K 24/02*** | (2006.01) |
| ***B43K 25/02*** | (2006.01) |
| ***B43K 24/08*** | (2006.01) |

(52) U.S. Cl.

CPC ..... *B43K 25/028* (2013.01); *B43K 24/08* (2013.01); *B43K 24/02* (2013.01)

(58) Field of Classification Search

CPC ..... B43K 24/02; B43K 25/028
USPC ..... 401/104, 109
See application file for complete search history.

(56) References Cited

U.S. PATENT DOCUMENTS

| | | | | |
|---|---|---|---|---|
| D59,052 | S | 9/1921 | Worthy et al. | |
| 1,468,562 | A | 9/1923 | Gilman, Jr. | |
| 1,649,142 | A | 11/1927 | Thornblad | |
| 2,219,769 | A | 10/1940 | Dorfman | |
| D179,615 | S | 1/1957 | Spatz | |
| 4,205,924 | A | 6/1980 | Sumita | |
| 4,221,491 | A | 9/1980 | Ganz | |
| 4,968,168 | A | 11/1990 | Chern | |
| 5,152,626 | A | 10/1992 | Eppler | |
| 5,651,626 | A * | 7/1997 | Chen | B43K 7/005 401/104 |
| 6,062,756 | A | 5/2000 | Sasaki | |
| D436,624 | S | 1/2001 | Zier | |
| 6,305,865 | B1 | 10/2001 | Yoshii et al. | |
| D466,933 | S | 12/2002 | Ferrara, Jr. | |
| D472,923 | S | 4/2003 | Wang | |
| 6,592,279 | B1 * | 7/2003 | Kagel | B43K 24/02 401/104 |

(Continued)

*Primary Examiner* — David Walczak
*Assistant Examiner* — Joshua Wiljanen
(74) *Attorney, Agent, or Firm* — Sand & Sebolt

(57) ABSTRACT

A pen is provided that utilizes actuating components of a conventional push-button type ballpoint, but which are actuated in a novel and unique manner by the use of an externally mounted lever. The externally mounted and movable lever provides a unique attractiveness to the pen and simulates the lever action used with Early American Western rifles, which in addition to providing a function to the pens, provides an attractive and unique-looking pen which can be combined with other features. A conical nose can be formed of brass which would simulate the end of a bullet and a tubular member can be formed of wood simulating a rifle stock. Also various engraving such as used on many Early American Western rifles can be incorporated into the outer surface of tubular member.

17 Claims, 7 Drawing Sheets

(56) References Cited

U.S. PATENT DOCUMENTS

| | | | | |
|---|---|---|---|---|
| 6,926,421 | B2 * | 8/2005 | Huang | B43K 24/02<br>362/118 |
| D556,825 | S | 12/2007 | Bruzzi | |
| D565,656 | S | 4/2008 | Silverstein | |
| D628,633 | S | 12/2010 | Zhang | |
| D666,891 | S | 9/2012 | Gulseth | |
| D678,942 | S | 3/2013 | Yuan | |

* cited by examiner

LEVER-ACTUATED PEN

CROSS REFERENCE TO RELATED APPLICATIONS

This application claims the benefit of prior U.S. Provisional Patent Application Ser. No. 62/183,224 filed Jun. 23, 2015, the entire disclosure of which is incorporated herein by reference.

BACKGROUND OF THE INVENTION

Technical Field

The present disclosure relates to writing instruments, and particularly to a ballpoint pen having an internal ink cartridge and writing tip which is projected from and retracted into an elongated housing though an opening located at a forward end of the housing. Even more particularly, the present disclosure relates to a pen having an external pivotally mounted lever extending along the pen which when pivotally moved from an at-rest position engages an operating mechanism within the housing for slidably moving the writing tip of the ink cartridge into and out of the opening of the housing.

Background Information

Ballpoint pens with retractable writing tips which use a push-button type operating mechanism have been used for a considerable number of years. These pens have an externally exposed button projecting from an open rear end of the pen and upon pushing the button inwardly into the tubular housing of the pen will overcome a biasing spring or springs to either retract or extend the writing tip from the open end of the pen.

These push-button pens have been, constructed of numerous types of materials from inexpensive plastic wherein the pen is a free give-away promotional item to pens formed of titanium, stainless steel, wood and other materials to provide an effective writing instrument having esthetic appeal to the user. However, all of these prior art pens use the rear extending push-button as the actuating mechanism. Prior art examples of such mechanical writing instruments having a push-button type actuating mechanism or similar structure can be found in U.S. Pat. Nos. 2,219,769, 4,205,924, 4,221,491, 4,968,168, 5,152,626, 6,062,756, and 6,305,865. Although these prior art push-button pens provide effective and sometimes ornamental writing instruments, users thereof and especially collectors of such pens, are looking for novel designs which are both attractive and ornamental and the pen of the present invention is believed to provide such a desired result.

SUMMARY

In one aspect, the invention may provide a lever-actuated pen comprising: an ink cartridge having a writing tip; an elongated housing having an open end containing the ink cartridge; an operating mechanism within the housing for projecting and retracting the writing tip through the open end of the housing; and a lever pivotally mounted on the exterior of the housing and operatively engageable with the operating mechanism within the housing for actuating said mechanism for projecting and retracting the writing tip.

In another aspect, the invention may provide a lever-actuated pen comprising: an elongated housing having a longitudinally extending bore terminating in an end opening; an ink cartridge having a writing point slidably mounted within the bore and moveable between an extended position wherein the writing point extends through the end opening of the bore and a retracted position wherein the writing point is withdrawn within the bore; a spring biasing the ink cartridge toward the retracted position; an actuating rod moveably mounted in the housing and operatively engageable with the ink cartridge enabling the writing point to move between the retracted and extended positions; a lever pivotally mounted externally on the housing and operatively engageable with the actuating rod within the housing for moving said rod into and out of operating engagement with the ink cartridge; and a cam mechanism operatively engaging the actuating rod and ink cartridge.

In accordance with one aspect, an embodiment of the present disclosure may provide a lever-actuated pen comprising: an elongated housing having a longitudinally extending bore terminating in an end opening, and the housing extending along a longitudinal axis; an ink cartridge having a writing tip slidably mounted within the bore and moveable between a projected position wherein the writing point extends through the end opening of the bore and a retracted position wherein the writing point is withdrawn within the bore; an operating mechanism within the housing for projecting and retracting the writing tip through the open end of the housing; and a lever pivotally mounted externally on the housing and operatively engageable with the actuating rod within the housing for moving said rod into and out of operating engagement with the ink cartridge.

In accordance with one aspect, an embodiment of the present disclosure may provide a method of operating a lever-actuated pen comprising the steps of: providing a pen comprising a lever pivotally mounted exterior an elongated pen housing operatively connected to an ink cartridge having a writing tip; pivotally rotating the lever about a pivot pin from a lever first position offset generally parallel to the exterior the elongated housing to a lever second positon angled relative to the elongated housing; and effectuating the ink cartridge to move between a projection position and a retracted position.

In accordance with another aspect, an embodiment of the present disclosure may provide a pen that utilizes actuating components of a conventional push-button type ballpoint, but which are actuated in a novel and unique manner by the use of an externally mounted lever. The externally mounted and movable lever provides a unique attractiveness to the pen and simulates the lever action used with Early American Western rifles, which in addition to providing a function to the pens, provides an attractive and unique-looking pen which can be combined with other features. A conical nose can be formed of brass which would simulate the end of a bullet and a tubular member can be formed of wood simulating a rifle stock. Also various engraving such as used on many Early American Western rifles can be incorporated into the outer surface of tubular member.

BRIEF DESCRIPTION OF THE SEVERAL VIEWS OF THE DRAWINGS

A sample embodiment of the present disclosure is set forth in the following description, is shown in the drawings and is particularly and distinctly pointed out and set forth in the appended claims.

DETAILED DESCRIPTION

Figure 1:
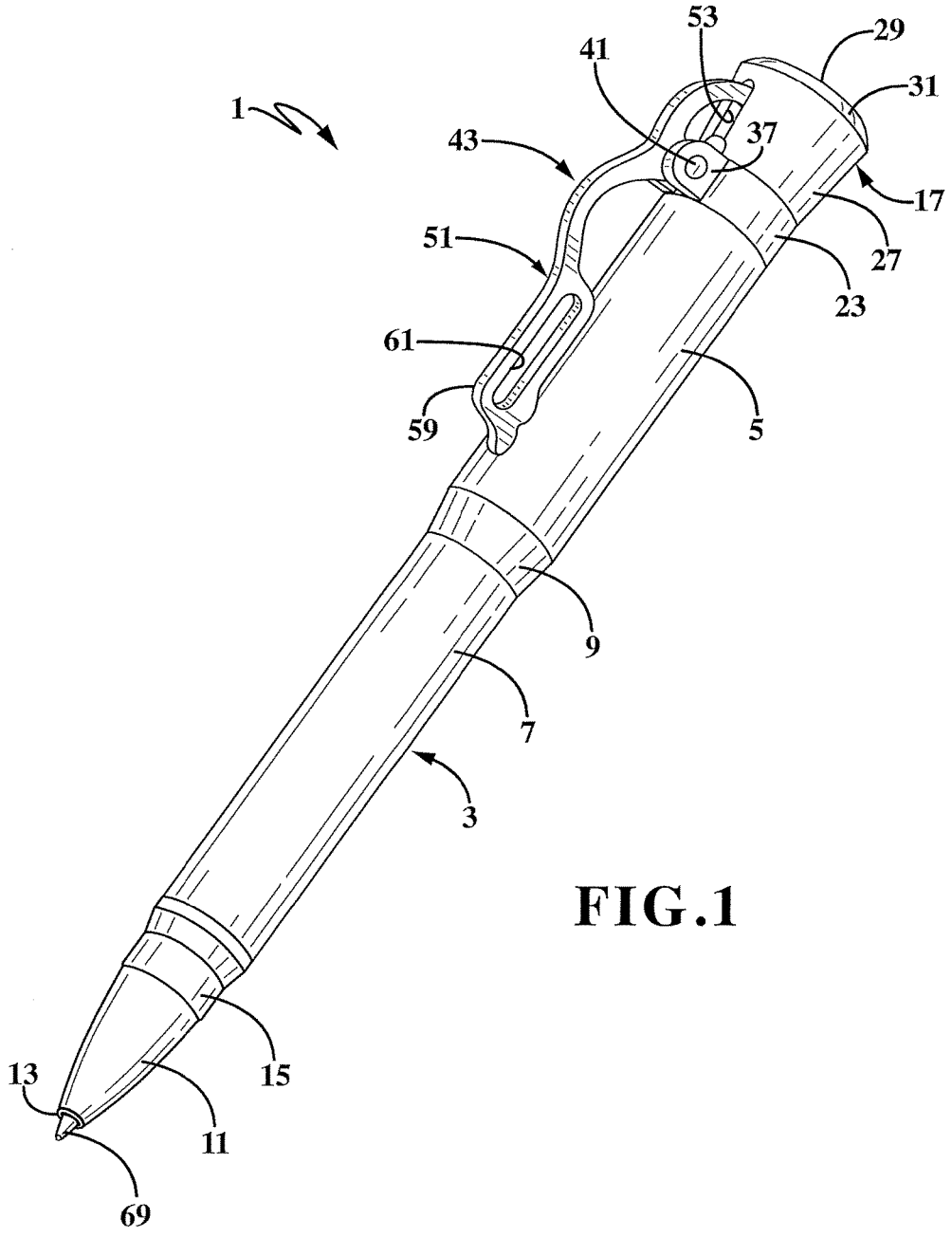
FIG. 1 is a perspective view of the lever-actuated pen of the present disclosure.

The lever-actuated pen of the present invention is indicated generally at 1, and is shown in FIG. 1 with the internal components thereof and method of operation shown in FIGS. 2-8. Pen 1 includes many of the components used by usual push-button pens. It has an elongated tubular housing indicated generally at 3, which may include an upper tubular portion 5 and a lower tubular portion 7 connected by a stepped coupler 9 which has a tight frictional sliding fit therebetween. Lower tubular portion 7 is connected to a conical nose section 11 having an end opening 13. Conical section 11 is connected to tubular portion 7 by another annular coupler 15 providing a tight frictional sliding fit therebetween.

Figure 2:
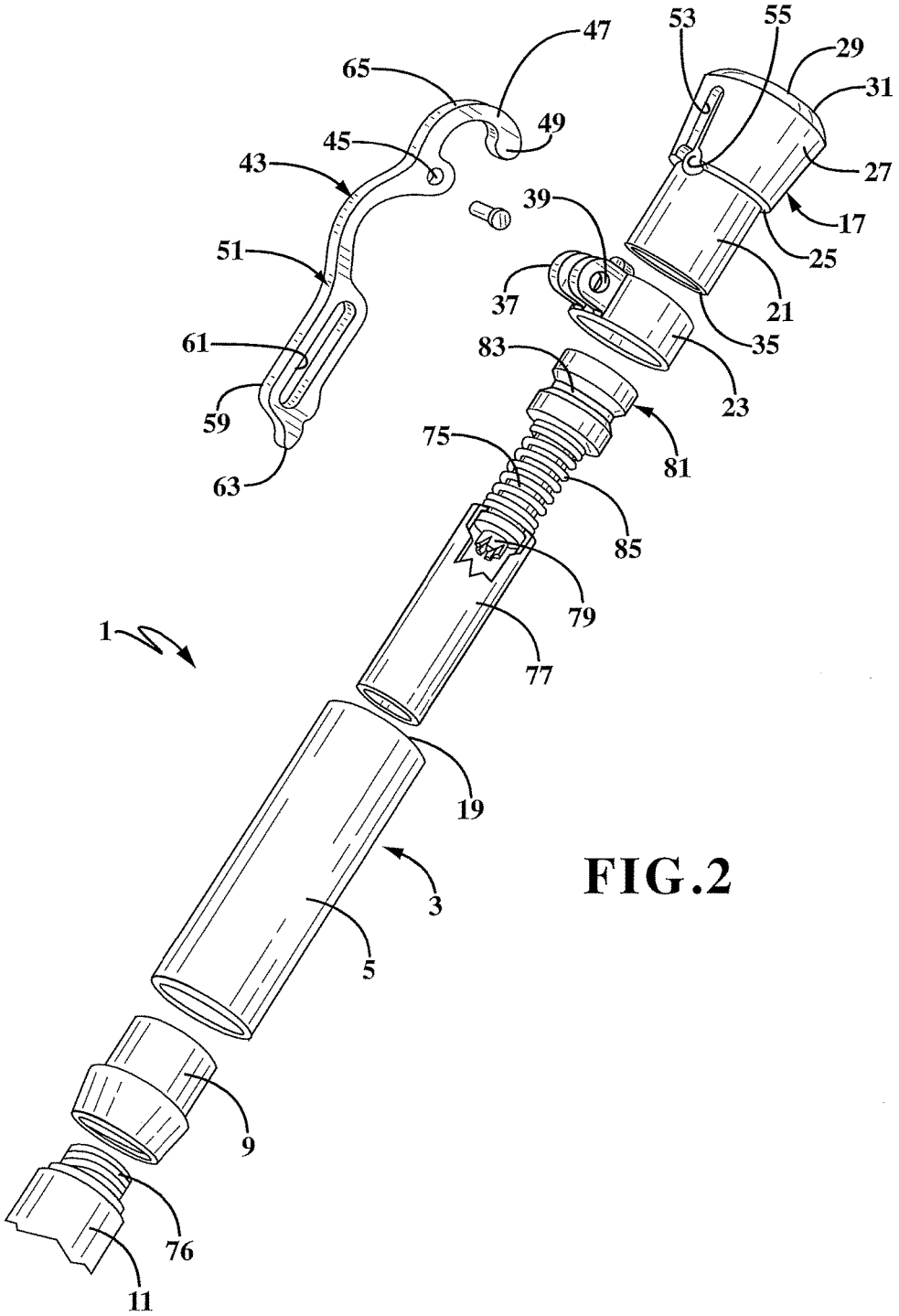
FIG. 2 is an exploded perspective view of the upper portion of the pen of FIG. 1.
Figure 3:
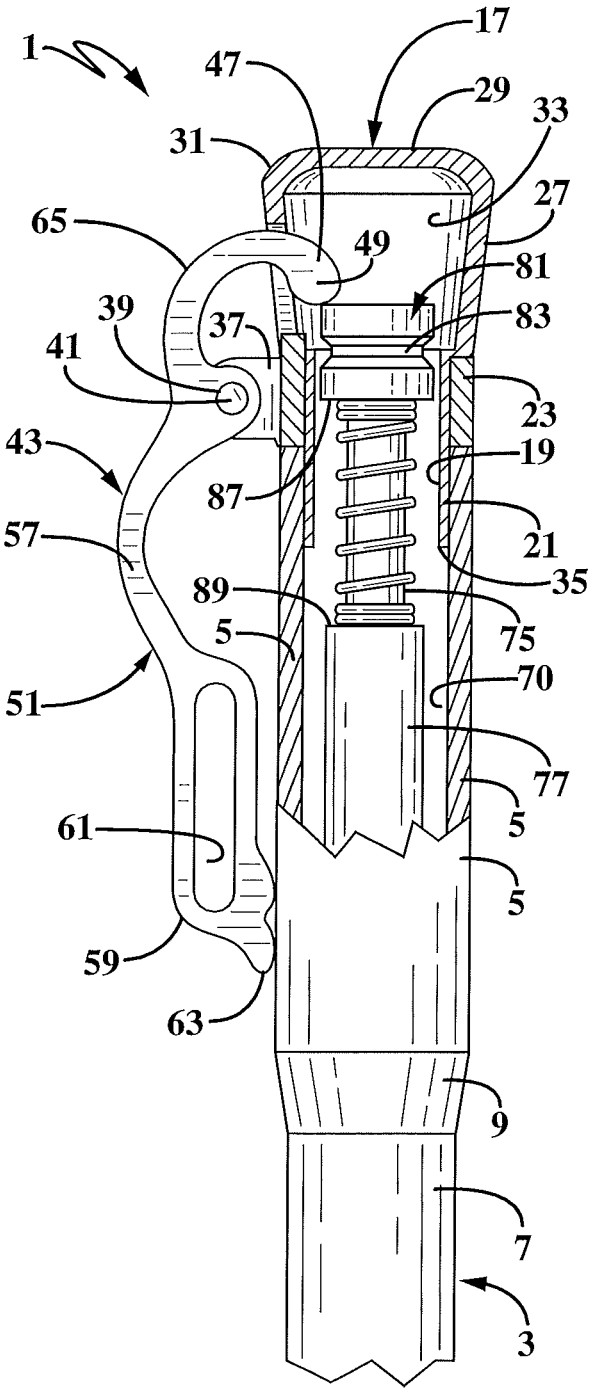
FIG. 3 is a fragmentary side elevational view with portions broken away and in section showing the upper portion of the pen and the internal actuating mechanism.

An end cap indicated generally at 17, is connected to an open upper end 19 of upper tubular section 5 by a tight frictional sliding engagement between open end 19 (FIG. 2) and a reduced cylindrical end portion 21 of end cap 17 (FIGS. 2 and 3). The outer diameter of cylindrical end 21 will be complementary to the internal diameter of opening 19 in order to provide for a tight sliding fit engagement therebetween. An annular collar 23 is slidably received over an upper portion of cylindrical end 21 and it is seated against an annular shoulder 25. Shoulder 25 is formed between cylindrical end 21 and an upwardly slightly outwardly tapered portion 27 of end cap 17 which terminates in a flat top 29 and joins with tapered portion 27 by a conically inwardly tapered section 31. End cap 17 is formed with a hollow interior 33 terminating in a lower open end 35. Collar 23 is formed with a pair of spaced outwardly extending tabs 37 formed with aligned holes 39 for receiving a pivot pin 41 therethrough.

Figure 7:
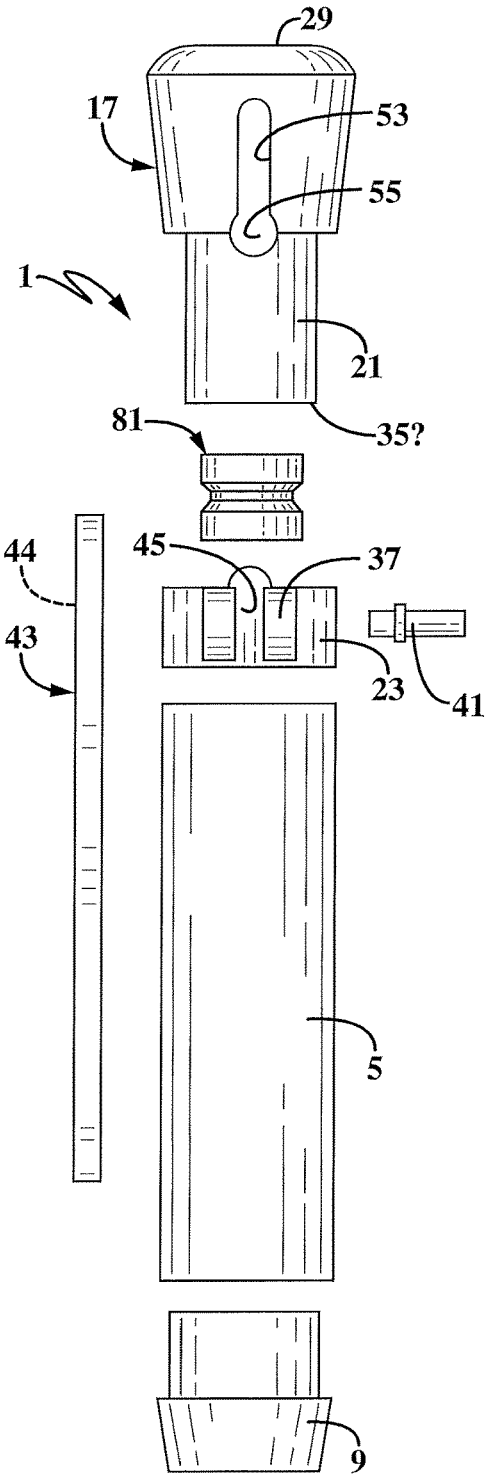
FIG. 7 is an exploded view of the upper components of the pen of FIG. 1.
Figure 8:
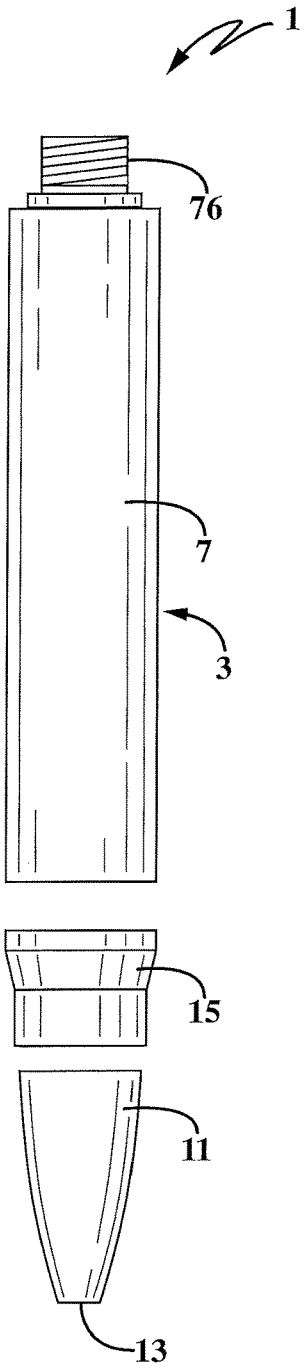
FIG. 8 is an exploded view of the lower components of the pen of FIG. 1. Similar numbers refer to similar parts throughout the drawings.

In accordance with one of the main features of the invention, a lever indicated generally at 43, is pivotally mounted in a space 45 formed between tabs 37 by pin 41 which extends through a hole 44 formed in lever 43. Lever 43 includes a curved inner or interior end 47 terminating in a rounded tip 49, and an elongated outer exposed end 51. When lever 43 is pivotally mounted on collar 23 by pin 41, interior end 49 thereof extends through a slotted opening 53 formed in end cap 17 which extends from cylindrical end 21 upwardly to adjacent conical section 31 thereof as shown in FIGS. 2, 3, and 7. Slotted opening 53 terminates at a slightly outwardly flared dome-shaped end portion 55 adjacent cylindrical end 21 and shoulder 25.

Lever 43 preferably is a one-piece member having an elongated configuration and is shown with an arch-shaped central portion 57 terminating in an elongated generally rectangular end 59 formed with an elongated rectangular-shaped opening 61. End 59 terminates in an outwardly projecting rounded nub 63. The interior end 49 of lever 43 also may be connected to elongated end 51 by a curved section 65. The particular configuration of lever 43 can have considerable differences in design than that shown in the drawings and described above without affecting the concept of the invention. The important features thereof is that lever 43 has an internal or interior end 47 which extends through slotted opening 53 in end cap 17, the purpose of which is discussed below, and has the elongated outer exposed end 51 for grasping and actuation of the lever by a user of the pen as discussed below.

Pen 1 is centered about a longitudinal axis 80 extending from flat top 29 which perpendicularly intersects longitudinal axis 80 to opening 13 of conical section 11. Unlike usual pens, portions of the actuation mechanism associated with moving ink cartridge 67 along the longitudinal axis 80 do not intersect the longitudinal axis 80, as will be described in greater detail below. Particularly, lever 43 is offset and positioned exterior the cylindrical sidewall surface of upper portion 5 of tubular housing 3. The lever 43 is held offset from longitudinal axis 80 by tabs 37 which extend radially outward from longitudinal axis 80. The pivot axis through which pin 41 enables lever 43 to pivot about is offset orthogonal to longitudinal axis 80. Furthermore, when pen 1 is held vertically in a traditional writing stance with the writing tip facing downward, the pin 41 is positioned vertically above the elongated rectangular-shaped opening 61 and nub 63. Thus, the rotating action of lever 43 about pin 41 draws the rectangular end 59 upwardly from a first position parallel to the tubular body to an angled second position when viewed in a side elevation view. However, it is entirely foreseeable that a pivot pin may be positioned along the tubular body adjacent the lower end of lever to enable the lever to pivot downwardly from a first position parallel to the tubular body to an angled second position when viewed in a side elevation view.

Figure 5:
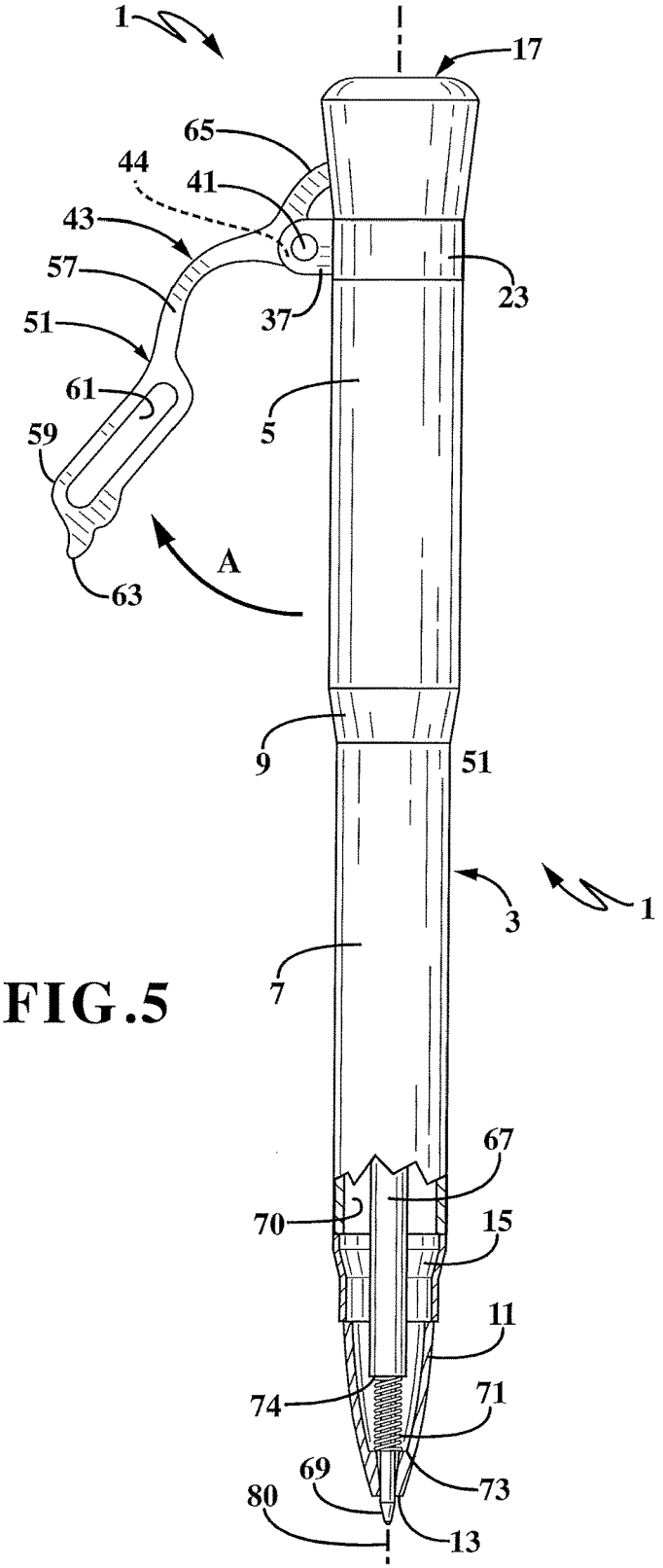
FIG. 5 is a partial sectional view showing the lever being pivotally moved into engagement with the internal operating mechanism of the pen.
Figure 6:
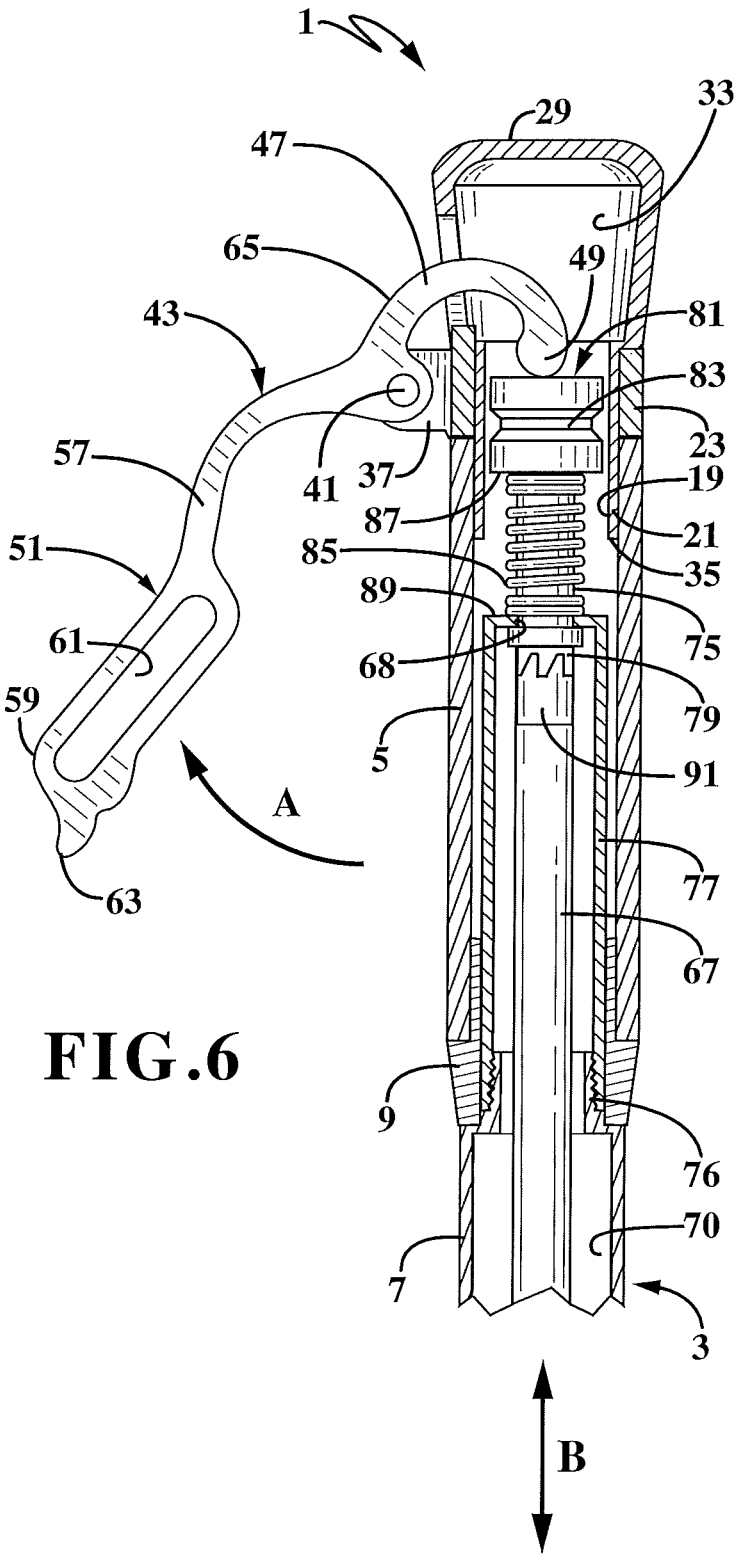
FIG. 6 is a sectional view showing the interior end of the lever moving the actuating rod longitudinally within the pen housing.

As indicated in FIG. 5, when lever 43 rotates about the pivot pin 41 in the direction of arrow A, the rounded tip 49 slidably moves in the radial direction atop knob 81. When lever 43 is in its uppermost position, as indicated in FIG. 6, the portions of lever 43 which are exterior slot 53 are angled relative to longitudinal axis 80. When the lever 43 is in the angled second position (FIG. 5), the angle formed between the elongated body of the lever 43 is in a range from about 10° to about 80° relative to longitudinal axis 80. In one particular embodiment, the angle formed between the elongated body of lever 43 is about 30°. Other embodiments may provide for a lever to operate that has an angled second position greater than 90°, with a maximum angled second position of about 180°. As will be described below, the movement of lever 43 effectuates the movement of the ink cartridge 67, and when lever 43 is in its greatest angled position relative to axis 80, then the writing tip of cartridge 67 is in its most projected position. While the Lever 43 may act us a clip to hold pen 1 within the pocket of an operator. While many usual and conventional pens include clips, ordinarily the clip is independent from the push button that actuates the ink cartridge. Thus, in accordance with the present disclosure, lever 43 enables a user to clip pen 1 to a pocket and also actuate ink cartridge 67 as discussed above.

The pivot connection is established by pivot pin 41 between tabs 37 and enables the movement of lever 43 in the direction of arrow A and the pivot connection ensures that lever 43 will not break when it is being pulled in the direction of arrow A. This is advantageous inasmuch as conventional pens utilize a clip extending along the longitudinal cylindrical sidewall of a pen body however, if an operator pulls the clip outwardly, the rigid connection of the clip with the upper portion of the pen will cause the clip to break closely adjacent the push button mechanism on a usual pen that is longitudinally aligned with its respective longitudinal axis. Furthermore, usual pens do not enable the clip to extend through the cylindrical sidewall of the body through a longitudinally aligned slot as indicated by slot 53.

A usual ink cartridge 67 is moveably mounted within a hollow bore 70 formed within and extending throughout the length of tubular portions 5 and 7 and of conical nose section 11, terminating in a writing tip 69. A compression coil spring 71 (FIGS. 4 and 5) surrounds a lower portion of ink cartridge 67 and is located within the lower end of bore 70 within conical nose section 11 where it abuts against a reduced diameter shoulder 73 adjacent opening 13 and a shoulder 74 formed in ink cartridge 67 biasing cartridge 67 toward a retracted position wherein tip 69 is concealed within the interior of nose section 11. An actuating rod 75 (FIGS. 2, 3 and 6) is slidably mounted within a sleeve 77 through an end opening 68. Sleeve 77 is retained with bore 70 of tubular section 5 by a lower threaded engagement with a reduced diameter threaded end 76 of tubular section 11. An end camming member 79 is formed on or attached to one end of rod 75 and an annular knob 81 is mounted on the outer end of actuating rod 75 and may be formed with an intermediate annular groove 83. Actuating rod 75 preferably is seated and secured within an opening formed in the lower end of knob 81 so as to be firmly fixed thereto. A compression coil spring 85 surrounds actuating rod 75 and is retained between a lower end 87 of knob 81 and the partially closed end 89 of sleeve 77 and biases knob 81 outwardly from sleeve 77 toward end cap 17 and into engagement with tip 49 of interior end 47 of lever 43 as shown in FIG. 3.

End camming member 79 operatively engages a camming end member 91 of ink cartridge 67. The engagement of camming member 79 and 91 moves ink cartridge 67 longitudinally within bore 70 as shown by Arrows B, FIG. 6, extending and retracting writing tip 69 through opening 13 depending upon the initial position of ink cartridge 67 in response to the actuation of lever 43 as described further below.

The actuation and movement of ink cartridge 67 and actuating rod 75 resulting in the camming engagement of cam members 79 and 91, as well as the function of compression coil springs 71 and 85, is the same action and operatively engagement of these members as occurs in a usual push-button ballpoint pen wherein an exposed button extends through an open end of the outer tubular member or housing, which when depressed by a user either retracts or extends the writing tip through the end opening. This particular actuating mechanism and components used for achieving such movement commonly found in a push-button type ballpoint pens, is merely one well-known operating mechanism and cooperation of components which is used to extend and retract the writing tip into and out of the open end of the pen and can have various other mechanisms to achieve the inward and outward motion of the writing tip without affecting the concept of the present invention.

The main feature of the present invention is the linear longitudinal movement of these mechanisms and components within the pen interior along the longitudinal axis 80 of the pen, by the use of externally located lever 43 which extends longitudinally along an outer portion of the pen having an internal actuating interior end 47 which replaces the heretofore push-button.

Figure 4:
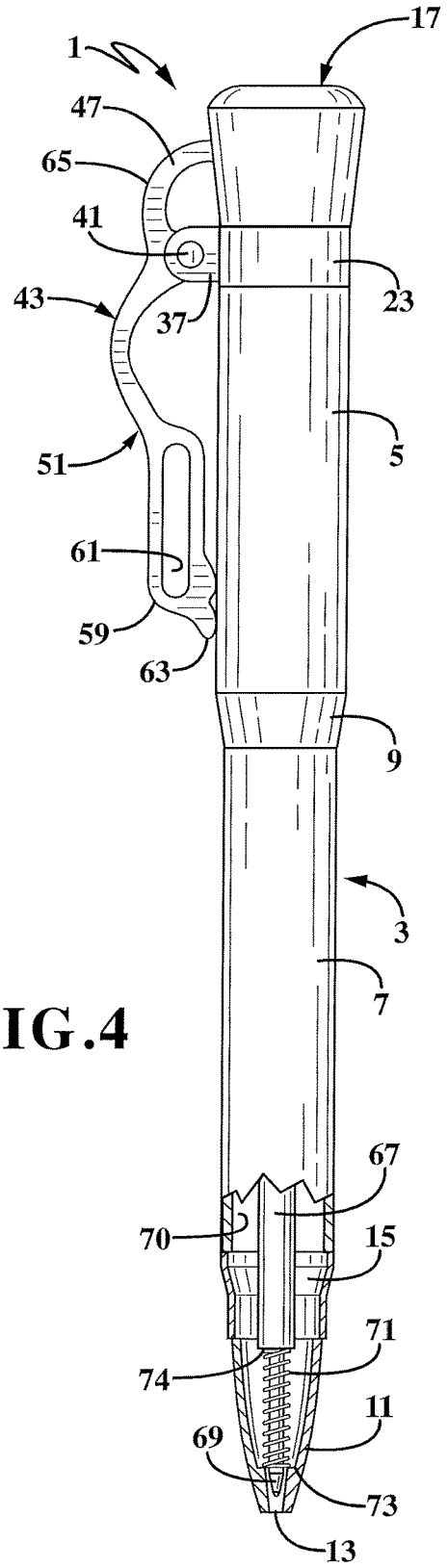
FIG. 4 is a partial sectional view of the pen of FIG. 1 with the writing tip in a retracted position.

When lever 43 is in the position as shown in FIGS. 3 and 4 in which the writing tip 69 is concealed within the pen, knob 81 is biased upwardly into engagement with lever tip 49 by spring 85, with spring 71 biasing ink cartridge 67 upwardly whereby cam member 91 is engaged with cam member 79 of rod 75. To move writing tip 69 from either the extended or retracted position, a user will grasp exposed end 51 of lever 43 and pivotally move it in the direction of Arrow A (FIGS. 5 and 6) which will cause interior end 47 to pivot about pivot pin 41 pushing lever tip 49 against knob 81 moving rod 75 into sleeve 77 whereupon cam member 79 at the end of actuating rod 75 will cammingly engage cam member 79 causing ink cartridge 67 to move outwardly overcoming the bias of spring 71 to an extended writing position as shown in FIG. 5. Lever 43 is then returned to its normal at rest position extending along the pen housing with writing tip 69 remaining in its outward writing extended position due to the camming engagement of cam members 79 and 91 as occurs in a usual push-button ballpoint pen.

To retract writing tip 69 into pen nose 11, lever 43 is again pivotally moved about pin 41 pushing downwardly against knob 81 causing further engagement between cam members 91 and 79 whereupon ink cartridge 67 will move inwardly into bore 70 of tubular sections 5 and 7. Again, this inward and outward movement of cartridge 67 and writing tip 69 is the same as that used for many years in the usual push-button ballpoint pen, and thus the camming action and means of engagement is not discussed in further detail. Examples of such push-button pens and the interior camming action can be of the type shown and described in detail in U.S. Pat. Nos. 5,152,626 and 6,305,865, the contents of which are incorporated herein by reference.

Pen 1 enables the usual and proven actuating components of the push-button type ballpoint pen to be utilized, but actuated in a novel and unique manner by the use of an externally mounted lever replacing the heretofore used rearwardly extending push-button. The externally mounted and movable lever provides a unique attractiveness to the pen and simulates the lever action used with Early American Western rifles, which in addition to providing a function to the pens, provides an attractive and unique-looking pen which can be combined with other features. For example, conical nose 11 can be formed of brass which would simulate the end or projectile of a bullet and tubular member 7 can be formed of wood simulating a rifle stock. Also various engraving such as used on many Early American Western rifles can be incorporated into the outer surface of tubular member 5. Thus, the combination of these ornamental and decorative features of nose 11 and tubular members 5 and 7, in combination with the lever action of lever 43, provides an efficient writing instrument as well as one having ornamental and possible collector features, all without sacrificing the ability of using pen 1 as an effective writing instrument.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

What is claimed:

1. A lever-actuated pen comprising:

an elongated housing defining a longitudinally extending bore terminating in an end opening, and the elongated housing extending along a longitudinal axis;

an ink cartridge having a writing tip slidably mounted within the bore and moveable between a projected position wherein the writing tip extends through the end opening of the bore and a retracted position wherein the writing point is withdrawn within the bore;

an operating mechanism within the housing for projecting and retracting the writing tip through the end opening;

a pivot pin defining a pivot axis that is spaced offset from the longitudinal axis;

a lever pivotally mounted externally on the housing to pivot about the pivot axis and operatively engageable with the operating mechanism within the housing for moving the ink cartridge between the retracted and projected positions; and wherein the lever includes an arch-shaped central portion terminating in an elongated generally rectangular end, and wherein the generally rectangular end is formed with an elongated rectangular-shaped opening.

2. A method of operating a lever-actuated pen comprising the steps of:

providing a pen including a lever pivotally mounted exterior an elongated housing operatively connected to an internally housed ink cartridge having a writing tip;

pivotally rotating the lever about a pivot pin offset from a longitudinal axis of the pen from a lever first position offset generally parallel to the exterior the elongated housing to a lever second position angled relative to the elongated housing, wherein the pivot pin is positioned below a top end cap and a portion of the lever moves through a slotted opening formed in the top end cap; and effectuating the ink cartridge to move between a projection position and a retracted position.

3. The method of claim 2, wherein the step of pivotally rotating the lever is accomplished by rotating the lever upwardly about the pivot pin.

4. The method of claim 2, wherein the step of pivotally rotating the lever about the pivot pin further comprises the step of moving an interior lever tip to push the ink cartridge linearly along a longitudinal axis.

5. A lever-actuated pen comprising:

an ink cartridge having a writing tip;

an elongated housing having an open end containing the ink cartridge;

an operating mechanism within the housing for projecting and retracting the writing tip through the open end of the housing;

a lever pivotally mounted on the exterior of the housing and operatively engageable with the operating mechanism within the housing for actuating the operating mechanism for projecting and retracting the writing tip;

wherein the operating mechanism includes a first spring biasing the ink cartridge toward the retracted position; an actuating rod moveably mounted in the housing and engageable by an internal end of the lever; an operating cam operatively coupling the actuating rod with the ink cartridge; and a second spring biasing the actuating rod toward the internal end of the lever;

wherein the elongated housing includes a first tubular section containing the actuation rod and second spring; a second tubular section containing the majority of the ink cartridge; and a nose section containing the first spring and writing tip; and wherein the housing includes an end cap attached to an end of the first tubular section; and in which the end cap is formed with a slot through which the internal end of the lever extends for engaging the actuation rod.

6. The lever-actuated pen defined in claim 5 wherein the first tubular section is formed of metal and the second tubular section is formed of wood.

7. The lever-actuated pen defined in claim 5 wherein the nose section is formed of brass and simulates the projectile of a bullet.

8. The lever-actuated pen defined in claim 5 wherein the housing further includes a collar mounted between the end cap and first tubular section; in which an at least one tab extends outwardly from the collar; and in which the lever is pivotably mounted on the tab.

9. The lever-actuated pen defined in claim 5 wherein the lever includes an elongated end extending along the housing defining an elongated opening simulating a lever of a lever-actuated rifle.

10. The lever-actuated pen defined in claim 9 wherein the elongated end of the lever includes a nub which rests upon the housing.

11. A lever-actuated pen comprising:

an elongated housing defining a longitudinally extending bore terminating in an end opening, and the elongated housing extending along a longitudinal axis;

a top end cap connected with the elongated housing;

an ink cartridge having a writing tip slidably mounted within the bore and moveable between a projected position wherein the writing tip extends through the end opening of the bore and a retracted position wherein the writing point is withdrawn within the bore;

an operating mechanism within the housing for projecting and retracting the writing tip through the end opening;

a pivot pin defining a pivot axis positioned below the top end cap; and a lever pivotally mounted externally on the housing to pivot about the pivot axis and operatively engageable with the operating mechanism within the housing for moving the ink cartridge between the retracted and projected positions.

12. The lever-actuated pen of claim 11, further comprising:

a lever first position offset generally parallel to the longitudinal axis exterior the elongated housing;

a lever second position angled relative to the longitudinal axis;

wherein the lever pivots between the lever first position and the lever second position.

13. The lever-actuated pen of claim 12, wherein the lever second position defines an angle between the lever and the longitudinal axis in a range from about 10° to about 80°.

14. The lever-actuated pen of claim 11, further comprising:

a slotted opening formed in an end cap; and an interior end on the lever extending through the slotted opening.

15. The lever-actuated pen of claim 14, further comprising:

the pivot pin positioned beneath the slotted opening when the pen is oriented with the writing tip facing downwardly, the pivot pin adapted to allow an end of the lever to pass through the slotted opening into the longitudinally extending bore.

16. The lever-actuated pen of claim 11, wherein the lever further includes an outwardly projecting rounded nub.

17. A lever-actuated pen comprising:

an elongated housing defining a longitudinally extending bore terminating in an end opening, and the elongated housing extending along a longitudinal axis;

an ink cartridge having a writing tip slidably mounted within the bore and moveable between a projected position wherein the writing tip extends through the end opening of the bore and a retracted position wherein the writing point is withdrawn within the bore;

an operating mechanism within the housing for projecting and retracting the writing tip through the end opening;

a pivot pin defining a pivot axis that is spaced offset from the longitudinal axis;

a lever pivotally mounted externally on the housing to pivot about the pivot axis and operatively engageable with the operating mechanism within the housing for moving the ink cartridge between the retracted and projected positions;

a slotted opening formed in an end cap;

an interior end on the lever extending through the slotted opening; and the pivot pin positioned beneath the slotted opening when the pen is oriented with the writing tip facing downwardly, and the pivot pin adapted to allow an end of the lever to pass through the slotted opening into the longitudinally extending bore.

* * * * *